US007546967B2

(12) United States Patent
Takahashi

(10) Patent No.: US 7,546,967 B2
(45) Date of Patent: Jun. 16, 2009

(54) TAPE PULLOUT APPARATUS AND TAPE PULLOUT METHOD

(75) Inventor: Nobuo Takahashi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 356 days.

(21) Appl. No.: 11/138,485

(22) Filed: May 27, 2005

(65) Prior Publication Data

US 2005/0263639 A1 Dec. 1, 2005

(30) Foreign Application Priority Data

May 27, 2004 (JP) ..... P2004-157158

(51) Int. Cl.
*G11B 15/66* (2006.01)

(52) U.S. Cl. ..... 242/332.3

(58) Field of Classification Search .... 242/332.3–332.5
See application file for complete search history.

(56) References Cited

U.S. PATENT DOCUMENTS 3,127,120 A * 3/1964 Selsted et al. ..... 242/332.1
3,398,913 A * 8/1968 Orlando ..... 242/332.3
3,643,889 A * 2/1972 Krause ..... 242/332.2
3,823,895 A * 7/1974 Jones et al. ..... 242/332.2
6,883,740 B2 * 4/2005 Hiraguchi ..... 242/332.4
2003/0146326 A1 * 8/2003 Hiraguchi ..... 242/332.4

FOREIGN PATENT DOCUMENTS

JP 2002-269711 A 9/2002

* cited by examiner

*Primary Examiner*—William A Rivera
(74) *Attorney, Agent, or Firm*—Sughrue Mion, PLLC

(57) ABSTRACT

A magnetic tape pullout apparatus adapted to pull out an end portion of a magnetic tape by attaching a circumferential surface of a wound magnetic tape, and provided with a tape pullout jig which is disposed so that a front end portion thereof can touch an outer circumferential surface of a wound magnetic tape, and which has on the lower side of this front end portion an attachment portion for attaching the magnetic tape thereto, a support member adapted to rotatably support the tape pullout jig in the radial direction of the wound magnetic tape, and a slide mechanism adapted to move the support member in the tangential direction of the wound magnetic tape.

15 Claims, 9 Drawing Sheets

TAPE PULLOUT APPARATUS AND TAPE PULLOUT METHOD

This application is based on Japanese Patent application JP 2004-157158, filed May 27, 2004, the entire content of which is hereby incorporated by reference. This claim for priority benefit is being filed concurrently with the filing of this application.

BACKGROUND OF THE INVENTION

1. Technical Field of the Invention

The present invention relates to an apparatus for and a method of pulling out a magnetic tape, adapted to attract via suction an outer circumferential surface of a wound magnetic tape and pull out an end portion thereof.

2. Description of the Related Art

FIG. 9 is a perspective view of a magnetic tape cartridge provided in a magnetic tape storage system. In the magnetic tape cartridge 1, a single reel 7 is housed rotatably in a cartridge case 5 formed by fastening an upper half 3*a* and a lower half 3*b* by screws and the like. The reel 7 has a divided structure in which a base portion integrally made of one flange and a boss is combined with the other flange, and a magnetic tape 9 is wound around the boss in a combined state. At a front end of the magnetic tape 9, a leader tape 13 to which a leader pin 11 is fixed is bonded. One side wall of the cartridge case 5 is provided with an opening 15 for pulling out the magnetic tape 9 therefrom, and this opening 15 is opened by and closed with a slide door 17 urged in the closing direction by an elastic means (not shown). When the magnetic tape cartridge 1 is not in use, the leader pin 11 at a terminal end of the tape is engaged with a recessed storage portion (not shown) formed in the vicinity of the opening 15 with the magnetic tape 9 and leader tape 13 completely wound around the reel 7. Such a magnetic tape cartridge is disclosed, for example, in JP-A-2002-269711.

The process for manufacturing the above-mentioned magnetic tape cartridge includes a step of pulling out from a wound magnetic tape an end portion thereof. In this tape pullout step, a tape pullout jig 19 a front end surface of which forms a suction surface 19*a* used during an air suction operation is moved toward the radial direction and away from the outermost layer of the wound magnetic tape 9, and the magnetic tape 9 in the outermost layer is thus attracted via suction and pulled out. Even when a wound quantity of the magnetic tape 9 is varied during this operation, the inconvenience can be dealt with advantageously by merely regulating the quantity of movement of the tape pullout jig 19 since the magnetic tape-end pullout jig 19 is moved in the radial direction of the wound magnetic tape 9.

However, when the movement of the tape pullout jig 19 is put forward from suction position shown in FIG. 10A to positions shown in FIGS. 10B and 10C, the magnetic tape 9 separates from the suction surface 19*a* as the jig 19 moves, and the magnetic tape 9 becomes easy to fall since the direction in which the suction surface 19*a* of the tape pullout jig 19 for the magnetic tape 9 extends and the direction of movement of the tape pullout jig 19 make substantially right angles to each other. In order to carry out this magnetic tape pullout step manually, it is necessary that this complicated magnetic tape pullout action and a magnetic tape payout action be made simultaneously. Therefore, these actions require a great deal of skill, and become an obstacle to the reduction of the man-hour and the improvement of the tactfulness of an operator. The present invention has been made in view of these circumstances.

SUMMARY OF THE INVENTION

An object of the invention is to provide an apparatus for and a method of pulling out a tape from a magnetic tape cartridge, capable of pulling out an end portion of a magnetic tape stably and reliably and thereby aims at attaining the reduction of the man-hour of the manufacturing of the magnetic tape cartridge and the improvement of the tactfulness of the operator.

This object of the present invention is attained by the following structures.

(1) A tape pullout apparatus adapted to attract via suction a circumferential surface of a wound magnetic tape and pull out an end portion of the magnetic tape, including a tape pullout jig which is provided so that a front end portion thereof can be touch the outer circumferential surface of the magnetic tape, and which has on a lower side of the front end portion thereof a suction portion adapted to attract via suction the magnetic tape thereto, a support member adapted to support the tape pullout jig rotatably in the radial direction of the wound magnetic tape, and a slide mechanism adapted to move the support member in the tangential direction of the wound magnetic tape.

According to this tape pullout apparatus, an end portion of the magnetic tape is attracted via suction to the suction portion of the tape pullout jig, and moved in the tangential direction of the magnetic tape. This enables the end portion of the magnetic tape to be pulled out stably and reliably, and the reduction of the man-hour of the manufacturing of the magnetic tape cartridge and the improvement of the tactfulness of the operator to be attained.

(2) A tape pullout apparatus according to (1) above, wherein a suction member for generating a vacuum pressure is provided, the tape pullout jig having an air passage for connecting the suction member and suction portion together, the suction portion being provided with suction holes for attracting via suction the magnetic tape to the suction portion.

According to this tape pullout apparatus, the air passage communicates with the suction portion in which the suction holes of the tape pullout jig are formed, an air suction operation is able to be carried out at the front end portion of the jig by a simple structure in which a pipe is not exposed to the outside, and a suction action is able to be made without difficulty even when a suction position is in a narrow region.

(3) A tape pullout apparatus according to (1) or (2) above, wherein the apparatus includes a circumferentially rotatable mechanism adapted to turn the tape pullout jig in the circumferential direction of the wound magnetic tape.

According to this tape pullout apparatus, the tape pullout jig is turned in the circumferential direction of the wound magnetic tape, so that the tape pullout jig can be provided at a suitable angle with respect to a radial position corresponding to the wound quantity of the tape. This enables a suction error to become more difficult to occur.

(4) A tape pullout method adapted to pull out an end portion of a magnetic tape by attracting via suction to an outer circumferential surface of the wound magnetic tape by using the tape pullout apparatus defined in any one of(1) to (3) above, wherein the method includes the steps of bringing the front end portion of the tape pullout jig close to the outer circumferential surface with a distance apart therefrom, bringing a lower side of the front end portion of the tape pullout jig into contact with the magnetic tape by a rotating movement of the support member, and moving the tape pullout jig in the tangential direction of the wound magnetic tape by the slide mechanism while attracting via suction the outermost layer of the magnetic tape to the suction portion at the lower side of the front end portion of the jig.

According to this tape pullout method, the end portion of the magnetic tape is attracted via suction to the suction portion of the tape pullout jig and moved in the tangential direction of the magnetic tape. The end portion of the magnetic tape thereby becomes able to be pulled out stably and reliably. This enables the reduction of the man-hour of the manufacturing of the magnetic tape cartridge and the improvement of the tactfulness of the operator to be attained.

According to the tape pullout apparatus and method of the present invention, the end portion of the magnetic tape can be pulled out stably and reliably, and the reduction of the man-hour of the manufacturing of the magnetic tape cartridge and the improvement of the tactfulness of an operator can be attained.

BRIEF DESCRIPTION OF THE DRAWINGS

FIGS. 4A and 4B are views showing one embodiment of the tape pullout jig for the tape pullout apparatus, in which FIG. 4A is a partially sectioned plan view of the tape pullout jig; and FIG. 4B is a side view.

FIGS. 6A and 6B are construction views showing one embodiment of the support member on which the tape pullout jig is supported, in which FIG. 6A is a front view; and FIG. 6B is a side view.

DETAILED DESCRIPTION OF THE INVENTION

Preferable embodiments of the tape pullout apparatus and method according to the present invention will be described in detail with reference to the drawings.

Figure 1:
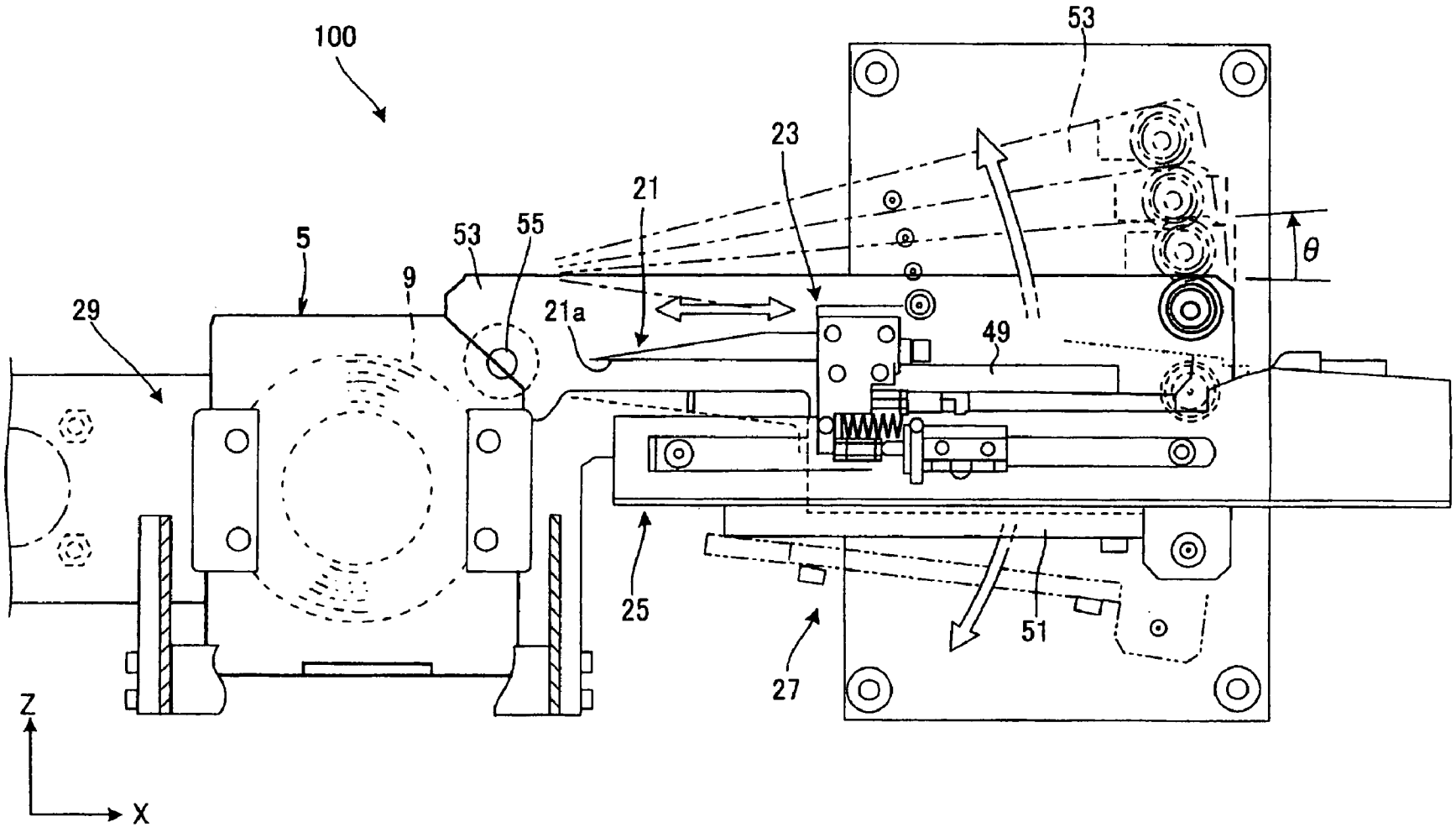
FIG. 1 is a front view showing one embodiment of the outline of the tape pullout apparatus according to the present invention.
Figure 2:
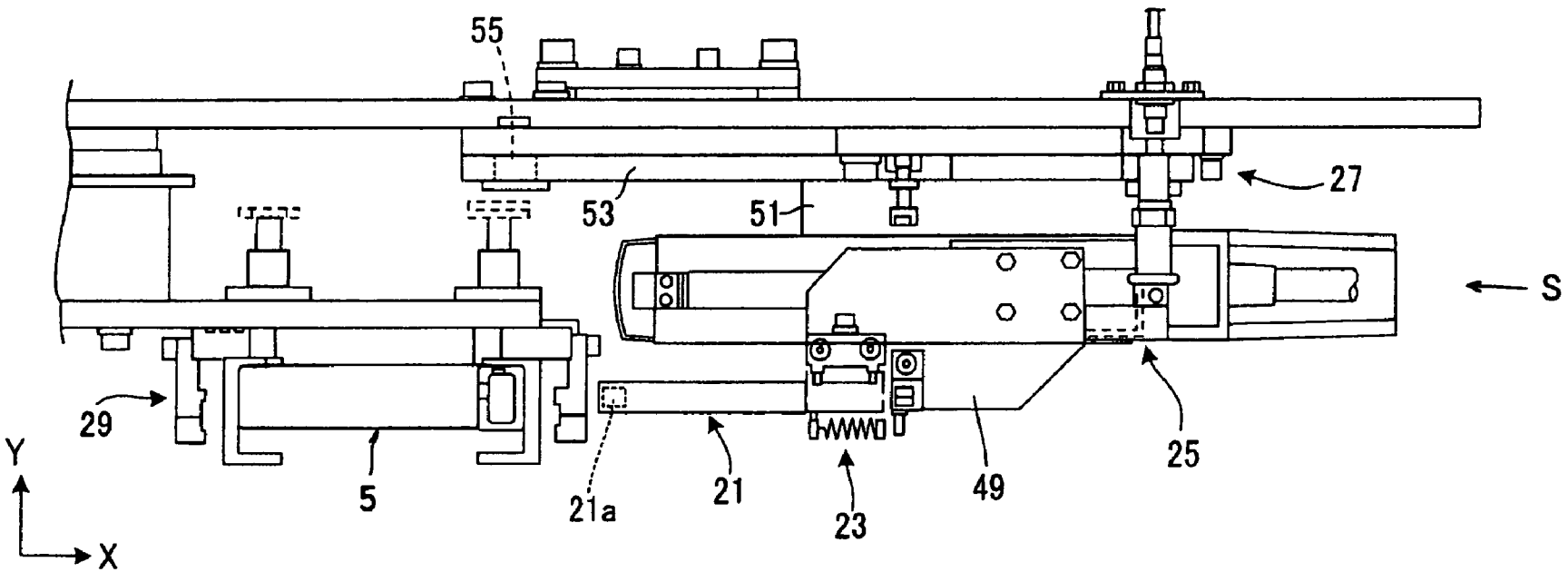
FIG. 2 is a plan view of the tape pullout apparatus of FIG. 1.
Figure 3:
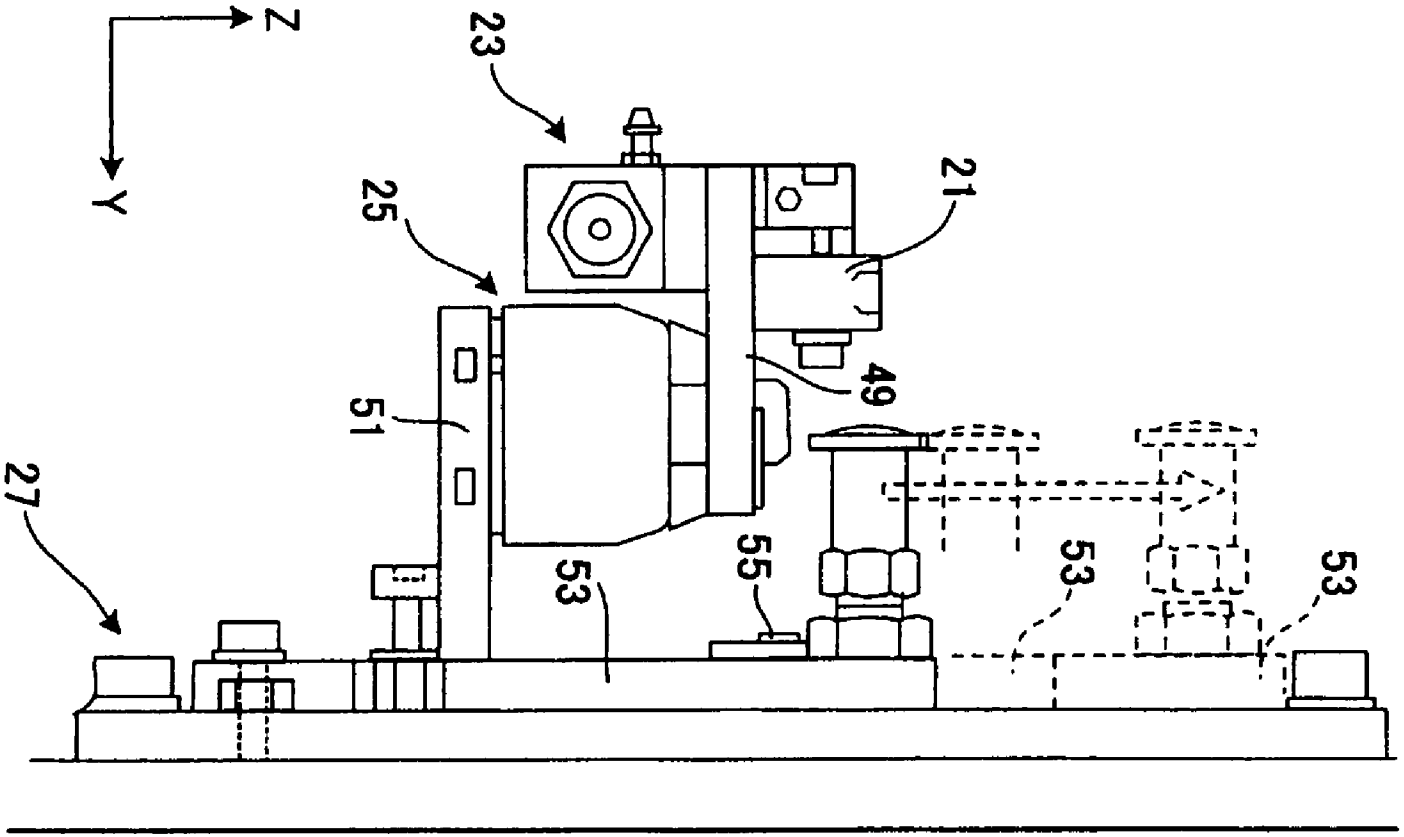
FIG. 3 is a side view of the tape pullout apparatus of FIG. 2 taken in the direction S therein.

FIG. 1 is a front view showing one embodiment of an outline of the tape pullout apparatus according to the present invention, FIG. 2 a plan view of the tape pullout apparatus of FIG. 1, and FIG. 3 a side view taken in the direction S of the tape pullout apparatus of FIG. 2.

As shown in FIG. 1 to FIG. 3, a tape pullout apparatus 100 is adapted to attract via suction to an outer circumferential surface of a wound magnetic tape 9 and pull out an end portion of the tape from a cartridge case 5. The apparatus includes as main structural elements a tape pullout jig 21 provided so that a front end portion thereof can be touch an outer circumferential surface of the wound magnetic tape 9, and having on a lower side of this front end portion a suction portion 21*a* for attracting the magnetic tape 9 thereto, a support member 23 adapted to support the tape pullout jig 21 rotatably in the radial direction of the wound magnetic tape 9, and a slide mechanism 25 adapted to move the support member 23 in the tangential direction of the wound magnetic tape 9.

The tape pullout apparatus 100 is provided with a circumferentially rotatable mechanism 27 adapted to turn the tape pullout jig 21 in the circumferential direction of the magnetic tape 9. Owing to this circumferentially rotatable mechanism 27, the slide mechanism 25, the support member 23 and tape pullout jig 21, which are mounted on the slide mechanism 25, are rendered possible to be turned in the circumferential direction as shown by two-dot chain lines in FIG. 1 and FIG. 3.

The tape pullout apparatus 100 is provided with a suction member, such as a vacuum pump for generating a vacuum pressure. The tape pullout jig 21, the details of which will be described later, has an air passage for connecting together the suction member and the suction portion 21*a*, which is formed on the lower side of the tape pullout jig 21. The suction member 21*a* is provided with a plurality of suction holes for attracting via suction the magnetic tape 9 thereto.

The tape pullout apparatus 100 is used in one step of a process for manufacturing a magnetic cartridge, and adapted to pull out an end portion of the tape in a state where the wound magnetic tape is housed in a cartridge case made of a lower half and an upper half.

Figure 4A:
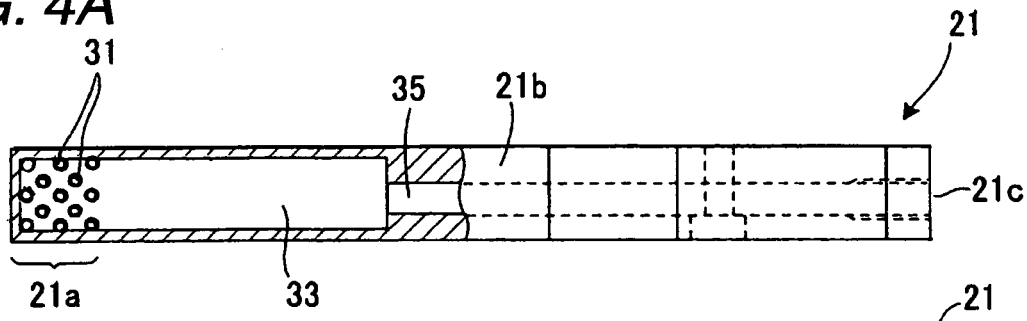
Figure 4B:
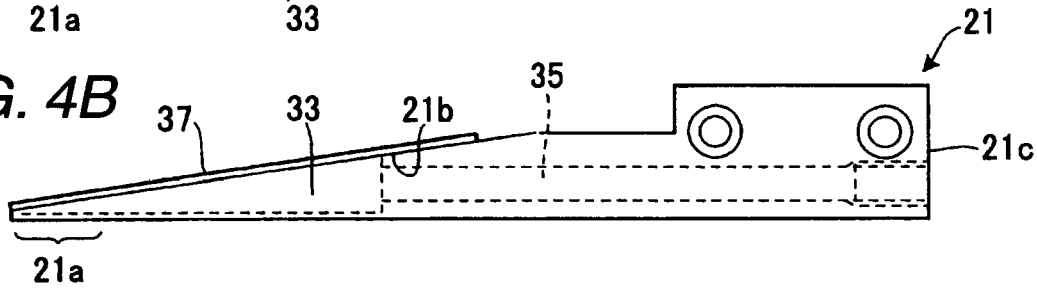

The tape pullout jig 21 provided in the tape pullout apparatus 100 is shown in FIGS. 4A and 4B. FIG. 4A is a partially sectioned plan view of the tape pullout jig, and FIG. 4B is a side view.

The tape pullout jig 21 has a wedge-like shape tapering off from a base portion thereof toward the front end portion thereof. The front end portion is provided with a suction portion 21*a* having a plurality of suction holes 31 in a lower side thereof, and a hollow space 33 including the suction portion 21*a* is defined. The space 33 is communicated with an end surface-side portion 21*c* through the air passage 35. A sheet member 37 for sealing the space 33 is fixed to the upper side of the tapering portion 21*b* of the tape pullout jig 21. When the air is sucked through the air passage 35, a suction action by the suction holes 31 of the suction portion 21 can be made. Since the air passage 35 communicating with the suction portion 21*a*, which is provided with the suction holes 31, of the tape pullout jig 21 is formed inside thereof, the air suction operation can be carried out by a simple structure in which the pipe is not exposed to the outside of the front end portion thereof. This enables the suction action to be made without difficulty even when the suction position is in a narrow region.

Figure 5:
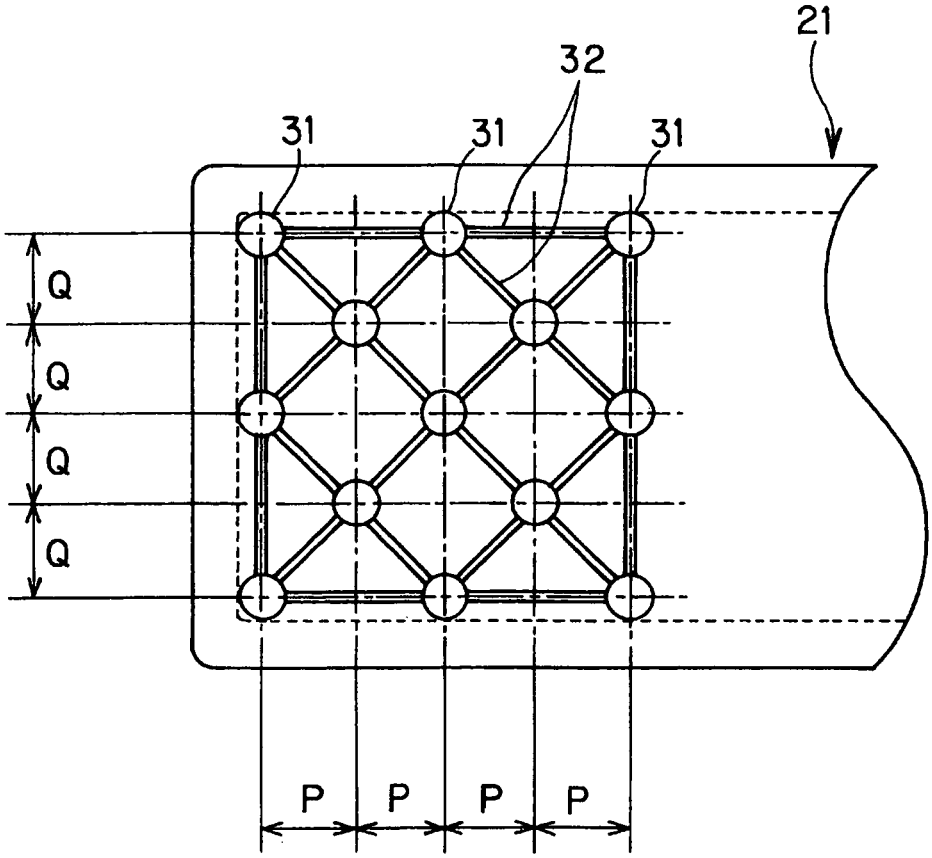
FIG. 5 is a plan view showing an example of the arrangement of the suction holes of the suction portion.

FIG. 5 shows an example of arrangement of the suction holes 31 of the suction portion 21*a*. The suction holes 31 are formed at predetermined intervals P, Q in a staggered manner in a bottom portion, which constitutes the bottom wall of the front end portion of the tape pullout jig 21. This causes the density of the suction holes 31 to be increased, and the adhesion of the tape by the air suction force to be improved. Moreover, grooves 32 are formed between adjacent suction holes 31, so that the substantial suction area is increased to cause the suction capacity to be heightened.

Figure 6B:
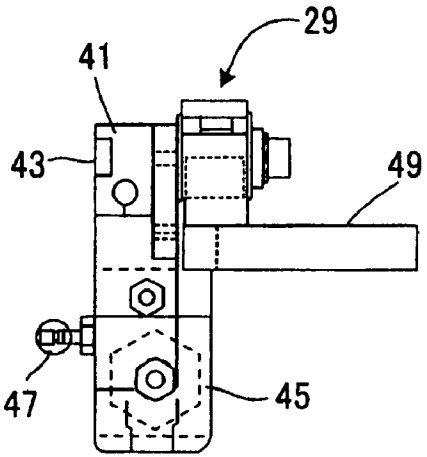
Figure 6A:
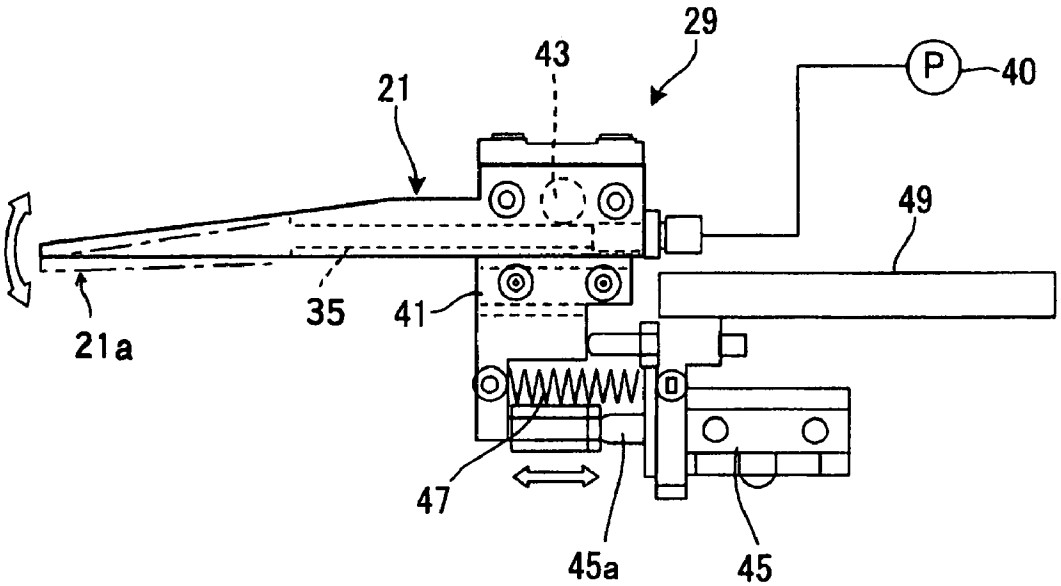

Such a tape pullout jig 21 is supported on the support member 23 shown in FIGS. 6A and 6B. The support member 23 is provided with a block 41 for fixing the tape pullout jig 21 thereto, an actuator, such as an air cylinder 45 and the like adapted to turn the fixing block 41 around a support shaft 43, an elastic member, such as a coiled spring 47 and the like adapted to urge the fixing block 41 in the direction opposite to the direction in which the air cylinder 45 is projected, and a plate 49 for securing the fixing block 41 to the slide mechanism 25. A vacuum pump 40 is connected to the tape pullout shaft 21 so that an operation for sucking the air from the suction portion 21*a* through the air passage 35 is carried out.

According to the tape fixing portion 29 of this structure, driving the air cylinder 45 to have a plunger 45*a* move forward and backward causes the fixing block 41 to be turned around the support shaft 43, and the tape pullout jig 21 secured to the fixing block 41 makes upward and downward turning actions as shown by an arrow in the drawing.

The circumferentially rotatable mechanism 27 will now be described in detail.

The circumferentially rotatable mechanism 27 is adapted to turn the slide mechanism 25, and the support member 23 and tape pullout jig 21 mounted thereon in the circumferential direction of the magnetic tape 9. As shown in FIG. 1 to FIG. 3, the slide mechanism 25 is supported on the base 51 (refer to FIG. 2 and FIG. 3), and the base 51 is connected to the rotatable plate 53. The rotatable plate 53 is supported on a support shaft 55 provided at the side of one end thereof which is near the tape fixing portion 29 so that the rotatable plate 53 can be turned around the support shaft 55.

Owing to this structure, the circumferentially rotatable mechanism 27 turns the rotatable plate 53 around the support shaft 55 as shown in FIG. 1. This enables the slide mechanism 25 and tape pullout jig 21 mounted on the rotatable plate 53 to be inclined from a horizontal plane by an arbitrary angle. The turning action of the rotatable plate 53 may be made manually but, when a suitable driving unit is provided, the same turning action can be automated. After the slide mechanism 25 and tape pullout jig 21 have been turned to a desired position, the rotatable plate 53 is locked by a suitable stopper, such as a screw tightening member and the like (illustration will be omitted).

The magnetic tape pullout action of the tape pullout apparatus 100 of the above-described structure will now be described in detail by using FIGS. 7A to 7B and FIGS. 8A and 8B.

Figure 7A:
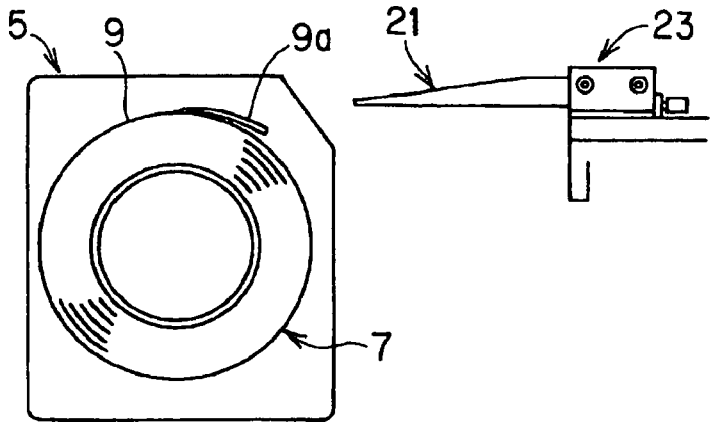
FIGS. 7A to 7D are explanatory views illustrating magnetic tape pullout actions to be made by the tape pullout apparatus.

As shown in FIG. 7A, the cartridge case 5 housing the wound magnetic tape 9 therein is first rotatably supported on the tape fixing portion 29. At a front end of the magnetic tape 9, the transparent end stopping tape 9*a* having a strength higher than that of the magnetic tape 9 is connected, and the winding position of this end stopping tape is set to a position (upper side in the drawing) in which the end stopping tape is easily attracted via suction to the tape pullout jig 21. The magnetic tape 9 in the drawing shows the condition thereof seen through the cartridge case 5.

Figure 7B:
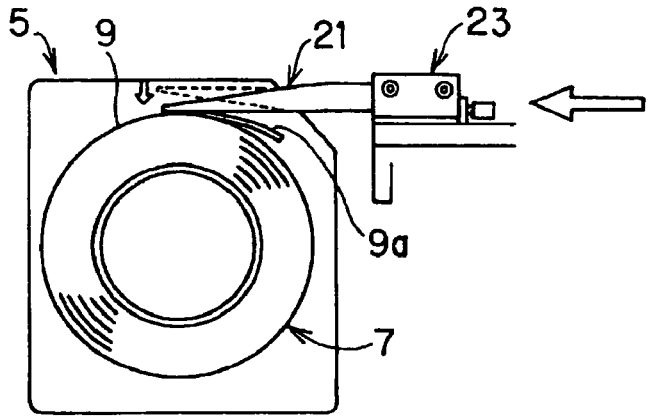
Figure 8A:
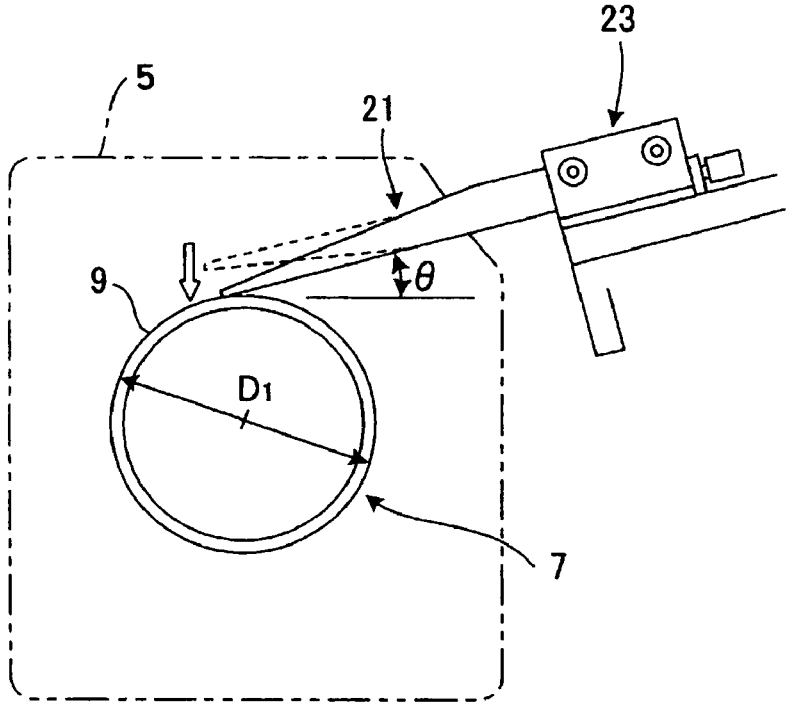
FIGS. 8A and 8B are explanatory views illustrating the different positions in which the tape pullout jig touches the magnetic tape with the outer size of the wound magnetic tape.
Figure 8B:
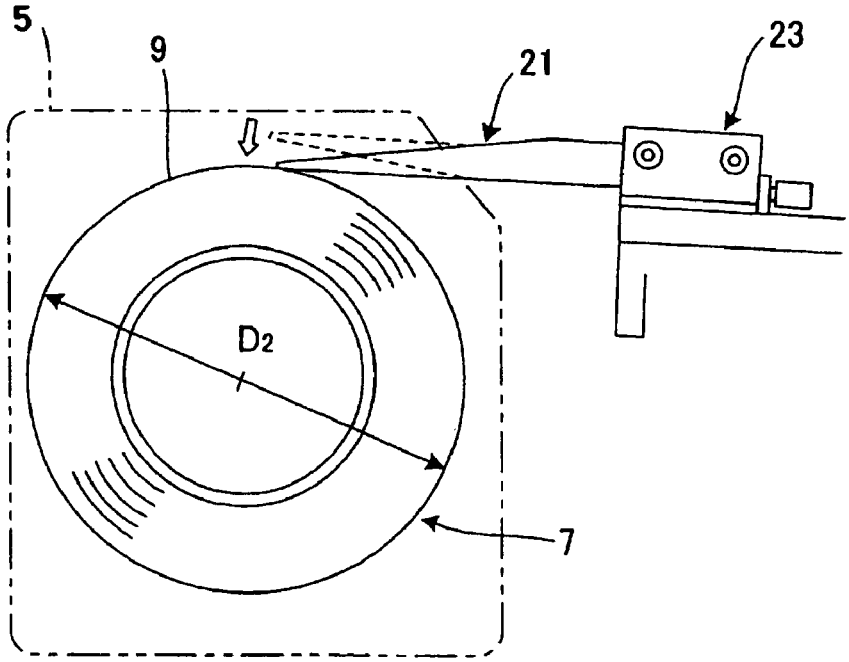
Figure 9:
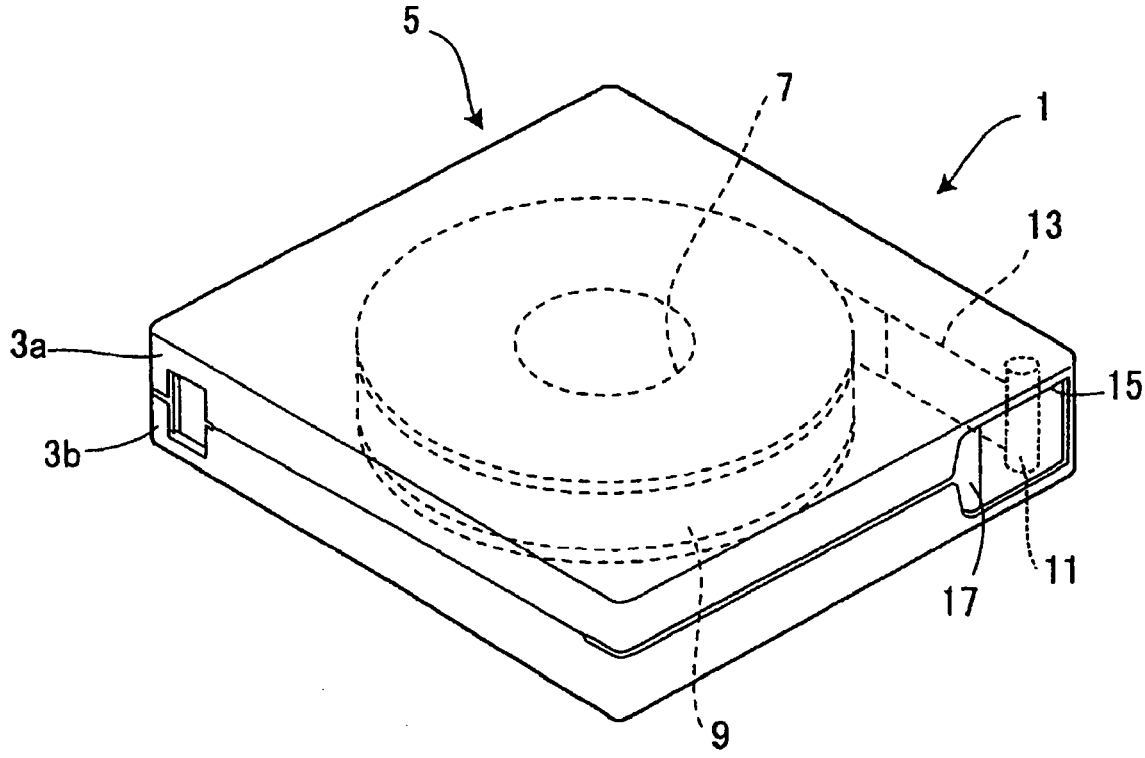
FIG. 9 is a perspective view of the magnetic tape cartridge provided for the magnetic tape storage system.
Figure 10A:
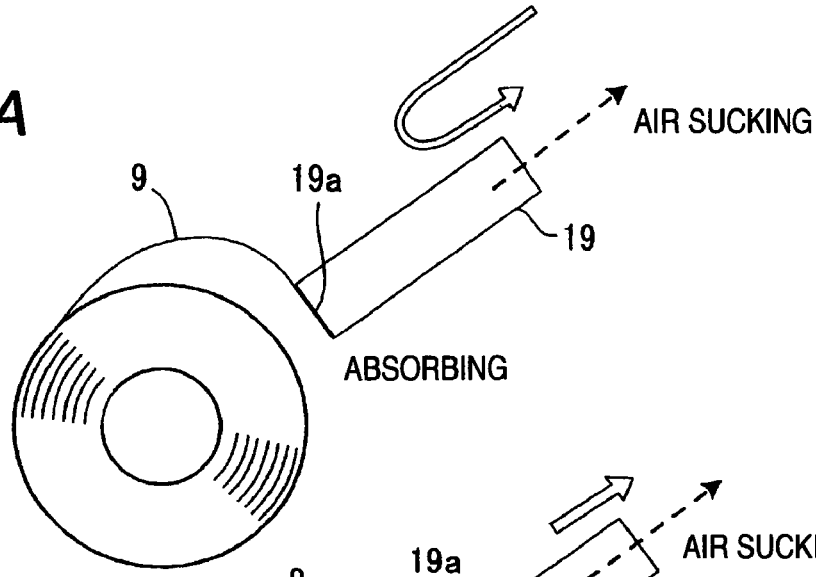
FIGS. 10A to 10C are explanatory views showing the related art process of pulling out the end portion of a magnetic tape.
Figure 10B:
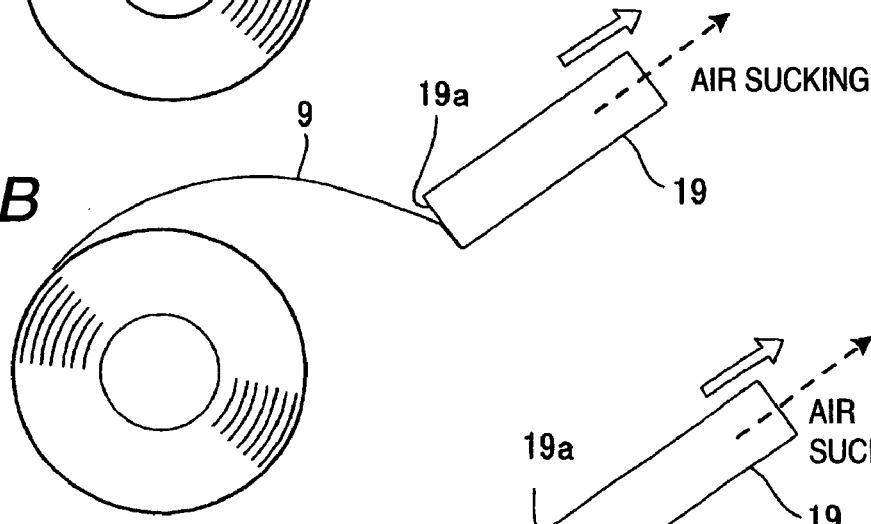
Figure 10C:
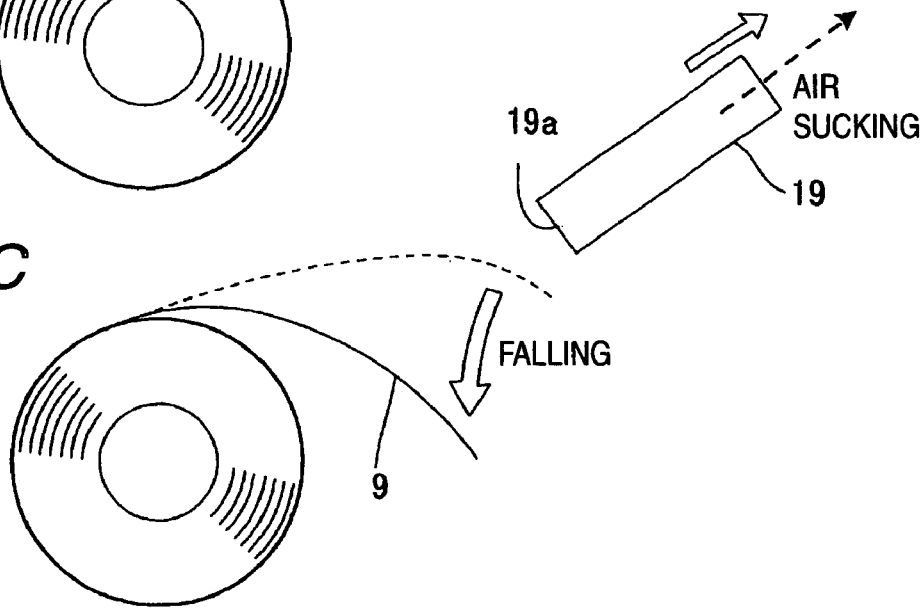

The outer size of the magnetic tape 9 is determined in accordance with the quantity of the wound tape, and stored in a storage portion of a memory circuit (not shown) and the like. The position in which the tape pullout jig 21 touches the outer circumferential surface of the magnetic tape 9 differs as shown in FIGS. 7A to 7B depending upon the outer size of the magnetic tape 9, so that a desirable direction of insertion of the tape pullout jig 21 also differs. Therefore, it is necessary that an angle θ of inclination of the tape pullout jig 21 from a horizontal plane be set. FIG. 8A shows a case where the quantity of the wound tape is small, and FIG. 8B is a case where the quantity of the wound tape is large. In the case of FIG. 8A where the quantity of the wound tape is small, the angle θ of inclination of the tape pullout jig 21 is set large, while, in the case of FIG. 8B, this angle of inclination is set small. This angle θ of inclination can be set in accordance with a turning movement of the rotatable plate 53 around the support shaft 55. Thus, according to this circumferentially rotatable mechanism 27, the tape pullout jig 21 can be disposed at a suitable angle, and a suction error can be rendered more difficult to occur.

The angle θ of inclination of the tape pullout jig 21 is then set to a desired level. The front end portion of the tape pullout jig 21 is then brought close by the slide mechanism 25 to the outer circumferential surface of the wound magnetic tape 9 with a clearance left therebetween, as shown by broken lines in FIG. 7B. When the air cylinder 45 of the support member 23 is driven in this condition. The lower side of the front end portion Of the tape pullout jig 21 is brought into contact with The outer circumferential surface of the magnetic tape 9 or the end stopping tape 9*a*. After the tape pullout jig 21 touches the magnetic tape 9, an air suction operation is started.

Figure 7C:
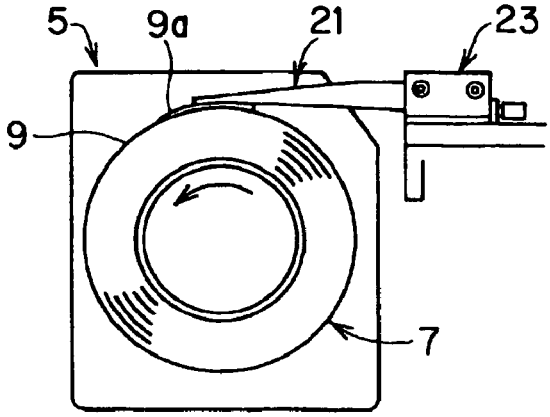

The reel 7 is then turned by a predetermined quantity with the front end portion of the tape pullout jig 21 left in contact with the outer circumferential surface of the magnetic tape 9 or the end stopping tape 9*a*, in the direction opposite to the direction in which the magnetic tape 9 is pulled out, as shown in FIG. 7C. Owing to this reverse rotating action, the end stopping tape 9*a* at the front end of the magnetic tape 9 is reliably attracted via suction to and retained by the suction portion 21*a* of the tape pullout jig 21. During this reverse rotational action of the reel, the suction power of the attachment portion 21*a* with respect to the end stopping tape 9*a* appears as an increase in the rotary torque. Therefore, the position in which the reel 7 rotated at a predetermined rotary torque is stopped can be set as a position of completion of the suction action, and the automation of the controlling of this action can be easily carried out.

Figure 7D:
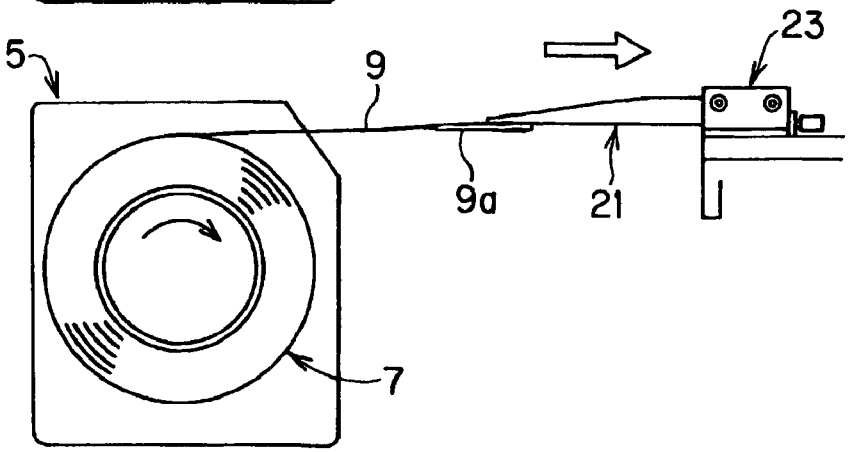

When the attraction via suction of the end stopping tape 9*a* is completed, the support member 23 is moved back by the slide mechanism 25 and the magnetic tape 9 is pulled out as shown in FIG. 7D. During this time, the reel 7 is rotated freely or so that such a quantity of tape that corresponds to the quantity of movement of the support member made by the slide mechanism 25 is fed.

Owing to this tape pullout action, the tape pullout jig 21 is moved in the tangential direction of the wound magnetic tape 9 while the end stopping tape 9*a* at the front end of the magnetic tape 9 attracted via suction to and retained by the suction portion 21*a* at the front end portion of the tape pullout jig 21. The magnetic tape 9 of the wound magnetic tape is thus pulled out. When a predetermined length of the tape is pulled out, the suction of the air is stopped, so that the front end of the magnetic tape 9 is hung down and provided for a subsequent stage.

During this action, the direction in which the magnetic tape 9 is pulled out is substantially parallel to the surface of the suction portion 21*a*. Therefore, the suction power of the suction portion 21*a* does not lower correspondingly to the tape pullout action, and the attraction via suction of the end stopping tape 9*a* can be maintained continuously and reliably.

In this tape pullout apparatus, the magnetic tape 9 can be pulled out simply. Therefore, when this operation is carried out manually, the pullout of the tape can be done simply and reliably without requiring a great deal of skill. When this operation is automated, the pullout of the tape can also be done easily. This enables the reduction of the man-hour of the manufacturing of the magnetic tape cartridge and the improvement of the tactfulness of the operator to be attained.

The construction of the above-described tape pullout apparatus 100 is not limited to the above-described construction, and a suitable design change can be made. For example, instead of the structure in which the magnetic tape 9 is attracted via suction to the tape pullout jig 21 by the air suction force, a structure in which the tape is attracted via suction to and retained by the jig by the static electricity can also be employed.

What is claimed is:

1. An apparatus comprising:

a tape pullout jig having a front end portion and a suction portion disposed on a contact surface of the front end portion, the suction portion attracting an outer circumferential surface of a wound magnetic tape via a suction force, and the contact surface coming into contact with the wound magnetic tape;

a support member that supports the tape pullout jig so that the tape pullout jig is capable of moving in a radial direction of the wound magnetic tape; and a slide mechanism that moves the support member in a direction of a tangent drawn from a contact point where the front end portion of the tape pullout jig comes into contact with the outer circumferential surface of the wound magnetic tape;

wherein the tape pullout jig has a wedge shape tapering off from a base portion thereof toward the front end portion thereof.

2. The apparatus according to claim 1, wherein the tape pullout jig is disposed so that the front end portion thereof is capable of touching the outer circumferential surface of the wound magnetic tape.

3. The apparatus according to claim 1, the apparatus comprises a rotating mechanism that turns the pullout jig in a circumferential direction of the wound magnetic tape.

4. The apparatus according to claim 1, wherein the apparatus comprises a suction member that generates a vacuum pressure, the tape pullout jig has an air passage that connects the suction member and the suction portion, and the suction portion has suction holes that attract the magnetic tape via the suction force.

5. The apparatus according to claim 4, wherein the suction holes are arrayed in a staggered manner.

6. The apparatus according to claim 4, wherein the suction portion has grooves formed between adjacent suction holes.

7. An apparatus comprising:

a tape pullout jig having a front end portion and a suction portion, the suction portion attracting an outer circumferential surface of a wound magnetic tape via a suction force, and the suction portion coming into contact with the wound magnetic tape;

a support member that supports the tape pullout jig so that the tape pullout jig is capable of moving in a radial direction of the wound magnetic tape;

a slide mechanism that moves the support member in a direction of a tangent drawn from a contact point where the front end portion of the tape pullout jig comes into contact with the outer circumferential surface of the wound magnetic tape; and a rotating mechanism that turns the pullout jig in a circumferential direction of the wound magnetic tape;

wherein the tape pullout jig has a wedge shape tapering off from a base portion thereof toward the front end portion thereof.

8. The apparatus according to claim 7, wherein the tape pullout jig is disposed so that the front end portion thereof is capable of touching the outer circumferential surface of the wound magnetic tape.

9. The apparatus according to claim 7, wherein the suction portion is disposed on a contact surface of the front end portion.

10. The apparatus according to claim 7, which comprises a suction member that generates a vacuum pressure.

11. The apparatus according to claim 10, wherein the tape pullout jig has an air passage that connects the suction member and the suction portion.

12. The apparatus according to claim 7, wherein the suction portion has suction holes that adsorbs the magnetic tape via the suction force.

13. The apparatus according to claim 12, wherein the suction holes are arrayed in a staggered manner.

14. A method for pulling out an end portion of a wound magnetic tape by using the apparatus according to claim 1, the method comprising the steps of:

bringing the front end portion of the tape pullout jig close to an outer circumferential surface of the wound magnetic tape with a distance apart from the outer circumferential surface, the tape pullout jig having a wedge shape tapering off from a base portion thereof toward the front end portion thereof;

bringing the contact surface of the front end portion into contact with the circumferential surface of the wound magnetic tape by a rotating of the support member; and moving the tape pullout jig in the direction of the tangent drawn from a contact point where the front end portion of the tape pullout jig comes into contact with the outer circumferential surface of the wound magnetic tape by a slide mechanism while attracting an outermost layer of the magnetic tape via a suction force to the suction portion at the contact surface of the front end portion of the tape pullout jig.

15. The method according to claim 14, which further comprises turning a reel around which the magnetic tape is wound by a quantity in a direction opposite to the direction in which the magnetic tape is to be pulled out.

* * * * *